US007841572B2

(12) United States Patent
Chen et al.

(10) Patent No.: US 7,841,572 B2
(45) Date of Patent: Nov. 30, 2010

(54) TOY SUPPORTING FRAME

(75) Inventors: Hong-Bo Chen, Taipei (TW); Chih-Wei Wang, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 77 days.

(21) Appl. No.: 12/270,827

(22) Filed: Nov. 13, 2008

(65) Prior Publication Data

US 2009/0130949 A1 May 21, 2009

Related U.S. Application Data

(60) Provisional application No. 60/988,390, filed on Nov. 15, 2007.

(51) Int. Cl.
*A47H 1/10* (2006.01)
*A63H 33/00* (2006.01)

(52) U.S. Cl. ..... 248/317; 248/284.1; 446/227; 446/228; 403/170

(58) Field of Classification Search ..... 248/317, 248/284.1, 168, 323, 324, 188.6, 188.7; 446/227, 446/228; 135/98, 901; 403/93, 170
See application file for complete search history.

(56) References Cited

U.S. PATENT DOCUMENTS

| | | | | |
|---|---|---|---|---|
| 3,919,795 | A * | 11/1975 | Van Horne Jinivisian et al. | 40/473 |
| 5,069,572 | A * | 12/1991 | Niksic | 403/170 |
| 5,797,695 | A * | 8/1998 | Prusmack | 403/170 |
| 6,086,284 | A * | 7/2000 | Callahan | 403/93 |
| 6,178,978 | B1 * | 1/2001 | Rieber | 135/96 |
| 6,295,667 | B1 | 10/2001 | Cheng | |
| 6,296,415 | B1 | 10/2001 | Johnson | |
| 6,464,555 | B1 | 10/2002 | Paduano | |
| 6,640,985 | B1 | 11/2003 | Cheng | |
| 6,938,291 | B1 | 9/2005 | Cheng | |
| 7,040,585 | B2 | 5/2006 | Cheng et al. | |
| 7,153,181 | B2 | 12/2006 | Cheng et al. | |
| 7,376,993 | B2 | 5/2008 | Myers et al. | |
| 2006/0101982 | A1 | 5/2006 | Hsieh | |

FOREIGN PATENT DOCUMENTS

| | | |
|---|---|---|
| EP | 1 720 152 A1 | 11/2006 |
| GB | 2 313 029 A | 11/1997 |

* cited by examiner

*Primary Examiner*—Anita M King
(74) *Attorney, Agent, or Firm*—Winston Hsu; Scott Margo

(57) ABSTRACT

Supporting pipes for hanging toys pivotally connect to each opening formed around a seat of a toy supporting frame with first ends and mount on a playard or a mattress with second ends. A rotary cover is further rotatably mounted on the seat and has openings corresponding to the openings of the seat. When the rotary cover rotates to a first position, the openings of the rotary cover align with the openings of the seat such that each supporting pipe is rotatable relative to the seat between an opening status and a folding status. When the rotary cover rotates to a second position, the openings of the rotary cover misalign with the openings of the seat such that each supporting pipe is retained in an opening status.

15 Claims, 7 Drawing Sheets

TOY SUPPORTING FRAME

CROSS REFERENCE TO RELATED APPLICATIONS

This application claims the benefit of U.S. Provisional Application No. 60/988,390, which was filed on Nov. 15, 2007, and is incorporated herein by reference.

BACKGROUND OF THE INVENTION

1. Field of the Invention

The present invention relates to a toy supporting frame, and more specifically, to a toy supporting frame that is foldable and mounted detachable from an infant product.

2. Description of the Prior Art

Many infant products such as mattress or playards for an infant lying or sitting often have toys for comforting the baby. Generally the toys are configured on the infant product by hanging or suspending thereon and can be removed for saving room when the toys are not in use. Expectation from consumers tells that the toy supporting frame should be foldable for saving room and carrying-friendly.

SUMMARY OF THE INVENTION

The present invention provides a toy supporting frame. The toy supporting frame comprises a seat, a plurality of supporting pipes, and a rotary cover. The seat has a plurality of pivoting openings. Each of the plurality of supporting pipes is utilized for hanging a toy and has a first end placed in one of the pivoting openings and pivotally connects to the seat so as to move between an opening status and a folding status. The rotary cover is mounted on the seat and has a plurality of third openings. The rotary cover is rotatable relative to the seat between a first position that the plurality of third openings align with the plurality of pivoting openings respectively for allowing the plurality of supporting pipes to move to the folding status, and a second position that the plurality of third openings misalign with the plurality of pivoting openings for retaining the plurality of supporting pipes in the opening status.

The present invention also provides a folding device. The folding device is utilized for a toy supporting frame and comprises a seat and a rotary cover. The seat has a plurality of pivoting openings. The rotary cover is mounted on the seat and has a third opening. The rotary cover is rotatable relative to the seat between a first position that the third opening aligns with one of the plurality of pivoting openings, and a second position along the axle on the seat such that the third opening misaligns with any of the plurality of pivoting openings. The plurality of pivoting openings is capable of pivotally connecting to an end of a supporting pipe for allowing the supporting pipe to move between an opening status and a folding status relative to the seat.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
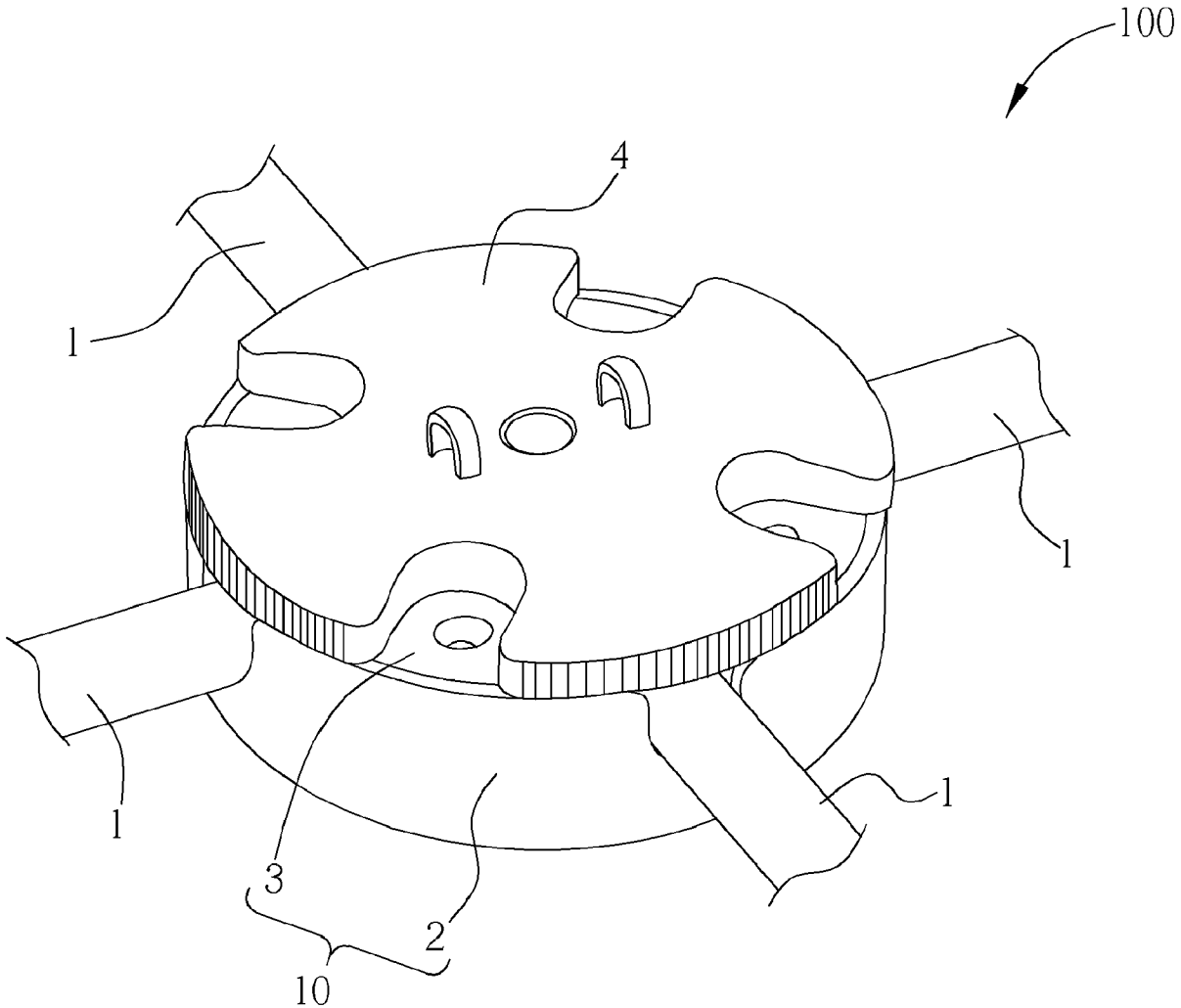
FIG. 1 is an illustration of a toy supporting frame disclosed in the present invention.
Figure 2:
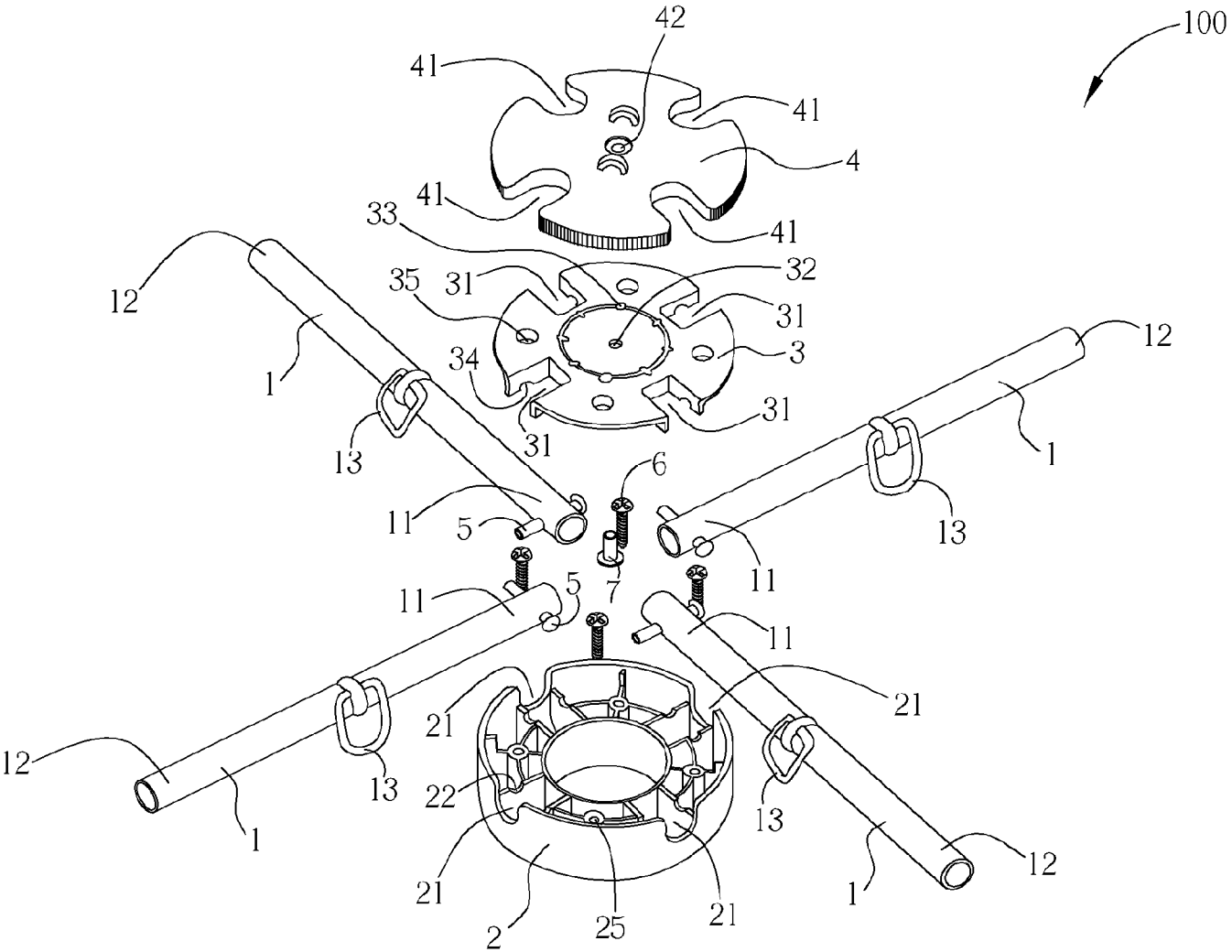
FIG. 2 is an illustration of exploded view of the toy supporting frame in FIG. 1.
Figure 3:
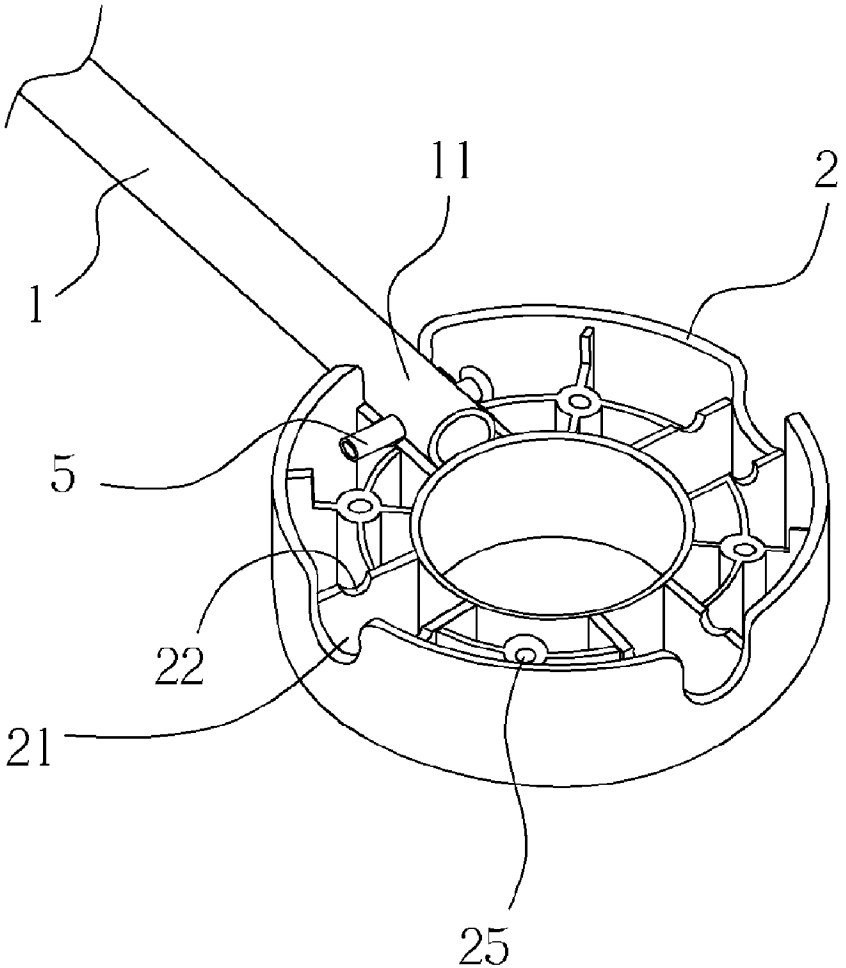
FIG. 3 is an illustration of the toy supporting frame with the supporting pipe pivoting to the first base.
Figure 4:
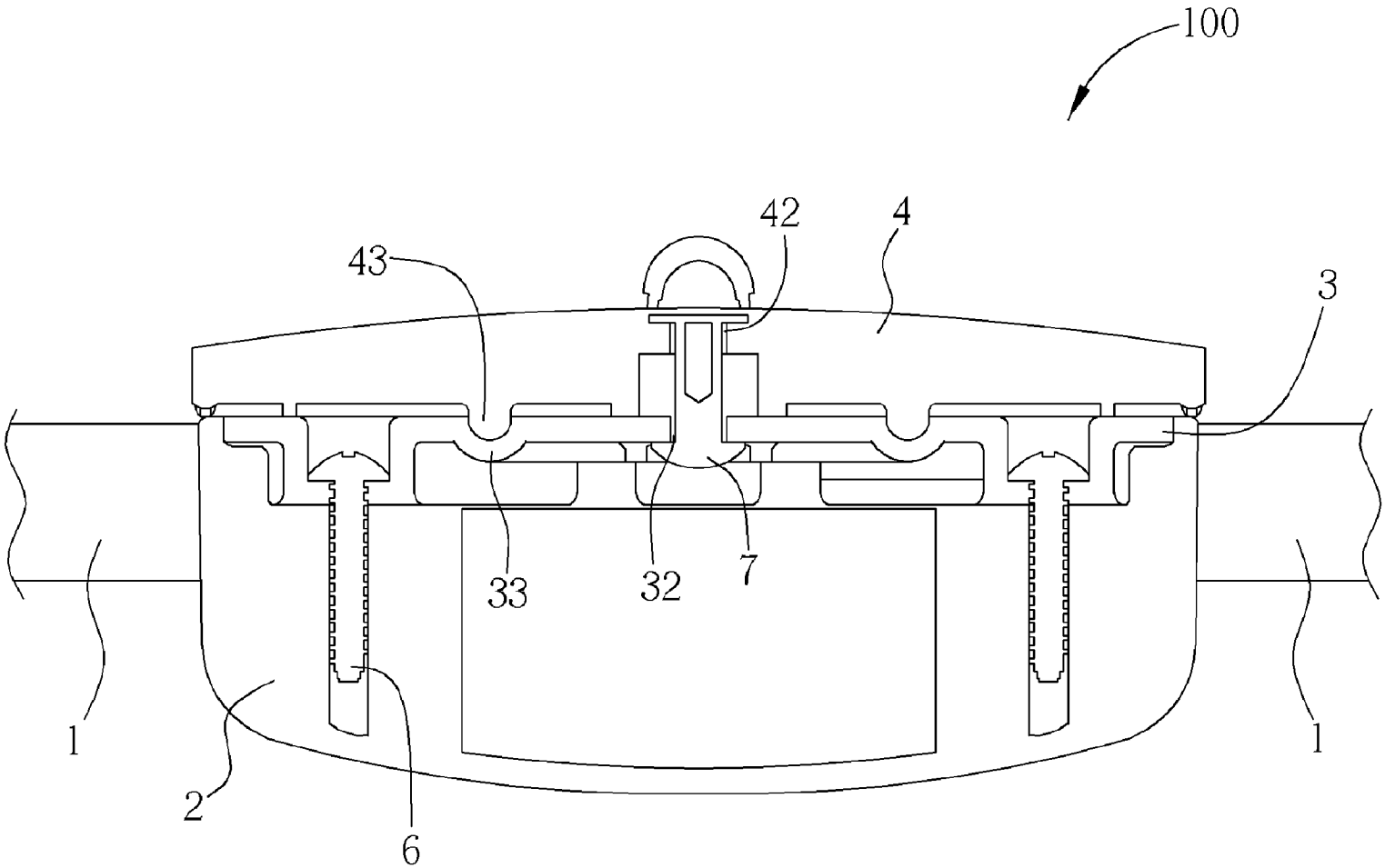
FIG. 4 is an illustration of cross-section view of each component of the toy supporting frame assembling together.
Figure 6:
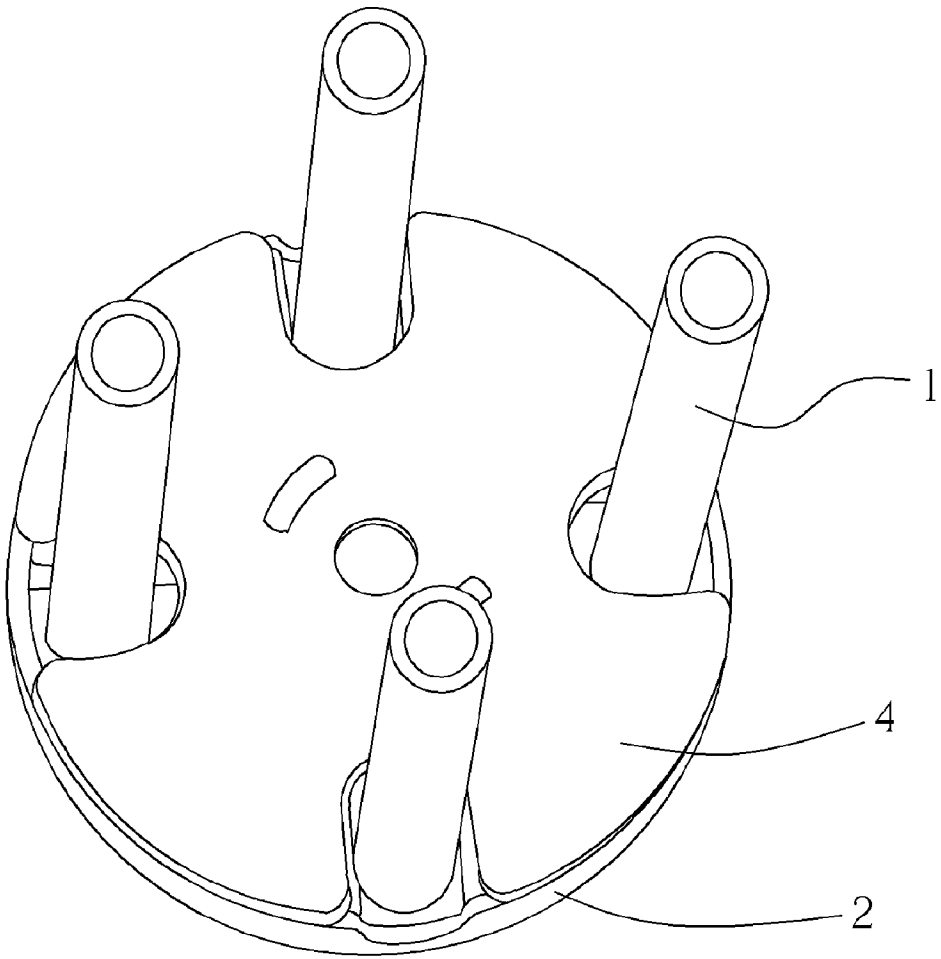
FIG. 6 is an illustration of the toy supporting frame with the supporting pipes pivoting to a folding status.
Figure 7:
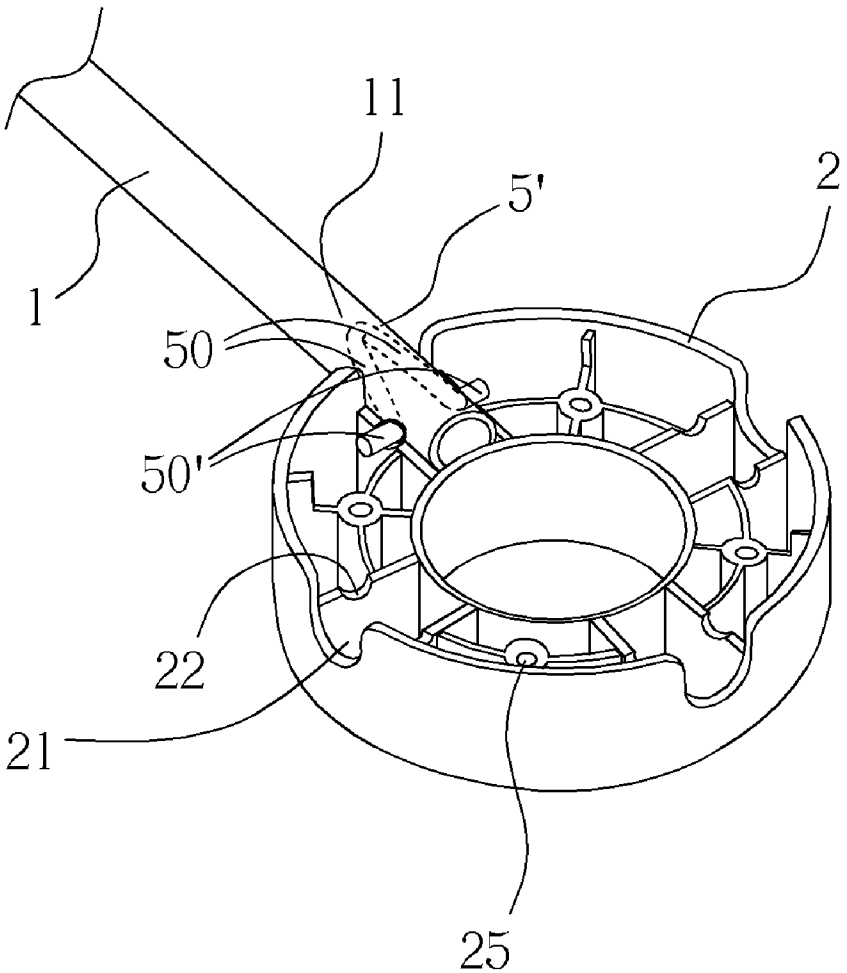
FIG. 7 is an illustration of the toy supporting frame showing the supporting pipe pivoting to the first base via a V-shape elastic piece.

Please refer to FIG. 1 and FIG. 2. FIG. 1 is an illustration showing an embodiment of a toy supporting frame 100 disclosed in the present invention, and FIG. 2 shows an exploded view of each component of the toy supporting frame 100. The toy supporting frame 100 can be mounted on a playard or a mattress and can be detached from thereon. The toy supporting frame 100 is capable of folding up to reduce overall size when not in use. As FIG. 1 and FIG. 2 show, the toy supporting frame 100 includes a seat 10, a rotary cover 4, and a plurality of supporting pipes 1, which in the embodiment, the seat 10 is composed of a first base 2 and a second base 3, while in other embodiments, the seat 10 can only be comprised with one integral component as the first base 2. Each supporting pipe 1 has a first end 11 pivotally connecting to the seat 10 and can be configured to an opening status as shown in FIG. 1 so as to mount on the playard of the mattress, or to a folding status as shown in FIG. 6 and detached from the playard or the mattress. The toy supporting frame 100 mounts on the playard or the mattress with a second end 12 of each supporting pipe 1.

Please refer to FIG. 2. The second base 3 can be secured to the first base 2 by a plurality of rivets 6 passing installing holes 35 on the second base 3 and installing holes 25 on the first base 2 respectively. A rivet 7 passes through installing hole 32 at the center of the second base 3 and installing hole 42 of the rotary cover 4 so that the rotary cover 4 pivots on the second base 3 and therefore is rotatable along the rivet 7 relative to the second base 3, which causes the rotary cover 4 to rotate relative to the seat 10 between a first position shown in FIG. 6 and a second position shown in FIG. 1.

Figure 5:
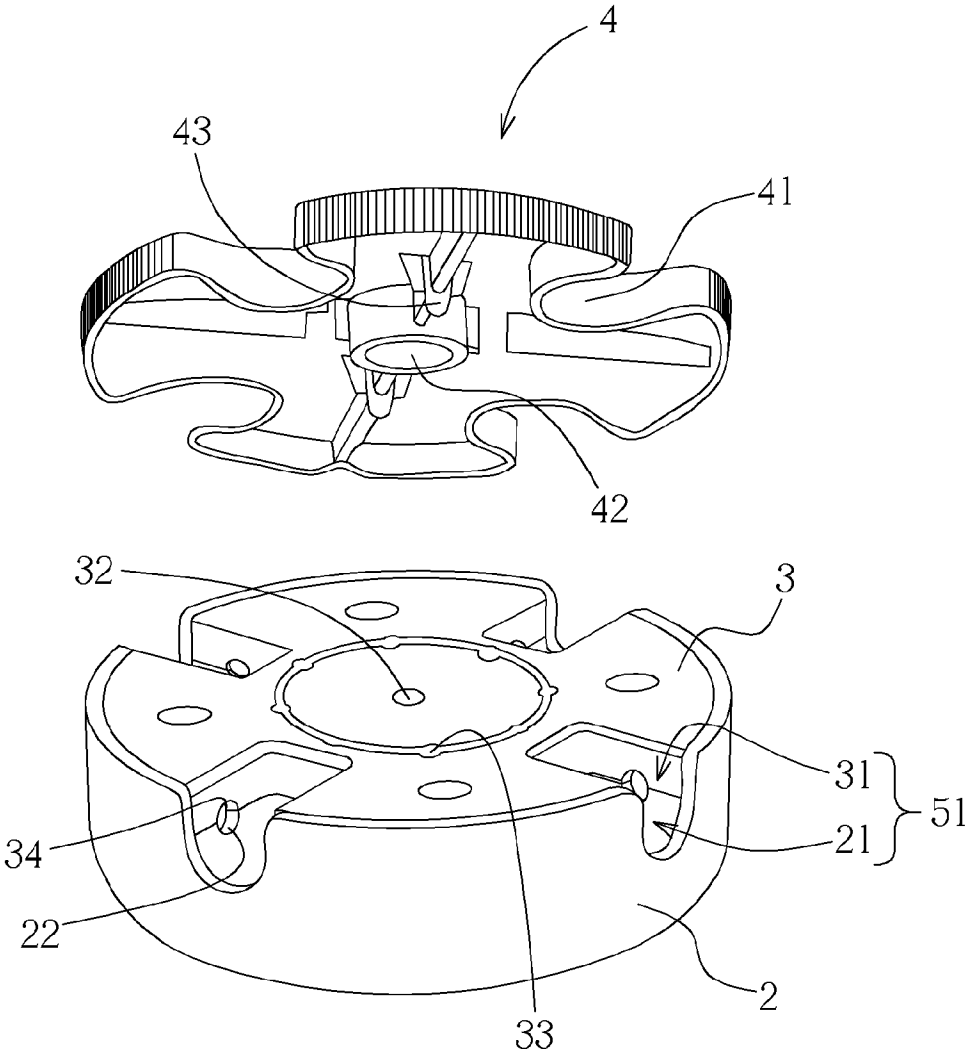
FIG. 5 is an illustration of the rotary cover and corresponding surfaces of other bases of the toy supporting frame.

Please refer to FIG. 2 together with FIG. 5, which is an illustration showing that the rotary cover 4 and corresponding surfaces of the first base 2 and the second base 3 of the toy supporting frame 100. The first base 2, in the embodiment, is hollow cylindrical and has a plurality of first openings 21 formed on the peripheral wall. The second base 3, accordingly, is circular that can fit in to the first base 2 and also has a plurality of second openings 31 formed at the periphery. As the second base 3 is secured to the first base 2, each second opening 31 corresponds to each first opening 21 so as to form a pivoting opening 51 at the periphery of the seat 10, as shown in FIG. 5.

Please refer to F*ig*.2 and F*ig*.3. F*ig*.3 is an illustration showing the toy supporting frame 100 with the supporting pipe 1 pivoting to the first base 2. The first base 2 has walls extending from the periphery to the center. Every two walls define a first opening 21 and each forms an indentation 22 at the top side. Likewise, the second base 3 has walls extending from the periphery to the center. Every two walls define a second opening 31 and each forms an indentation 34 at the bottom side. The toy supporting frame 100 further includes a plurality of pivots 5 that pass through each first end 11 of the supporting pipes 1 and are placed at the indentations 22 of each first opening 21. When the first base 2 and the second base 3 secure to each other, every indentation 22 on the first base 2 and corresponding indentation 34 on the second base 3 form a hole for receiving the corresponding pivot 5. Therefore, each supporting pipe 1 pivots to the first base 2 via the corresponding pivot 5 and with its first end 11 contained in the first opening 21 and the second opening 31. The first end 11 of each supporting pipe 1 is then capable of rotating in the pivoting opening 51 and the supporting pipe 1 can be pivoted relative to the first base 2 to the opening status or the folding status. In other embodiments, the first base 2 and the second base 3 can be formed as an integral component and the supporting pipes 1 can pivot to the seat 10 by other ways. For example, a V-shape elastic element 5' is configured inside each of the supporting pipes 1 as shown in *Fig*.7. The V-shape elastic element 5' has protrusions 50' at two arm ends 50 that extend out of the supporting pipe 1 to engage with a hole of the seat 10. The protrusions 50' of the V-shape elastic element 5' is formed as a pivot shaft for pivoting the supporting pipe 1 to the seat 10.

When the toy supporting frame 100 is mounted on the playard or the mattress, the supporting pipes 1 have hangers 13 for connecting various kinds of toys. The hangers 13 are shown in FIG. 2 and can be hooks, rings, or any detachable or fixed connectors.

In order to retain each supporting pipe 1 in the opening status when the toy supporting frame 100 is mounted on the playard, a plurality of third openings 41 are further deployed around the rotary cover 4 of the toy supporting frame 100. When the toy supporting frame 100 is mounted on the playard, each supporting pipe 1 of the toy supporting frame 100 expands to the opening status as shown in FIG. 1. Meanwhile, the rotary cover 4 is positioned to the second position relative to the second base 3, with each third opening 41 misaligning with each pivoting opening 51 of the seat 10. Each supporting pipe 1 at this status is confined to the opening status by the rotary cover 4 and is expanded radially. The second end 12 of each supporting pipe 1 is then mounted on the playard or the mattress respectively. Toys on the toy supporting frame 100 are hanged thereon through the hangers 13 for entertaining the baby in the playard or lying on the mattress. After the toy supporting frame 100 is detached from the playard or the mattress, the rotary cover 4 can rotate relative to the second base 3 to the first position as shown in FIG. 6. Each third opening 41 of the rotary cover 4 now aligns with each pivoting opening 51 of the seat 10 and each supporting pipe 1 is capable or pivoting relative to the first base 2 and the second base 3 to the folding status as shown in FIG. 6. All supporting pipes 1 fold and approach to one another to reduce overall size of the folded toy supporting frame 100. The toy supporting frame 100 can be easily set in the opening status or in the folding status by rotating the rotary cover 4.

Please refer to FIG. 5. During rotation of the rotary cover 4 about the second base 3, a plurality of first stops 33 (or recesses in this embodiment) on the surface of the second base 3 that faces the rotary cover 4 can engage with a plurality of second stops 43 (or protrusions in this embodiment) on the surface of the rotary cover 4 that faces the second base 3, and the rotary cover 4 can be retained in the first position or the second position. Both the first stops 33 of the second base 3 and the second stops 43 of the rotary cover 4 are circularly, axle-centeredly deployed on the surfaces in this embodiment. A predetermined force applying on the rotary cover 4 can disengage the second stops 43 of the rotary cover 4 from each of the first stops 33 of the second base 3 until each second stop 43 engages with the 'next' first stop 33 respectively. Based on the engagement between different first stops 33 and second stops 43 during rotation of the rotary cover 4, the supporting pipes 1 of the toy supporting frame 100 be confined to the opening status or free to rotate to the folding status in turn.

The present discloses a toy supporting frame for hanging toys and is mounted detachably to a playard or a mattress. Each supporting pipe pivotally connects to each opening formed around a seat of the toy supporting frame with its first end and mounts on the playard or the mattress with its second end. A rotary cover is further rotatably mounted along an axle on the seat and has openings corresponding to the openings of the seat. When the rotary cover rotates to a first position, the openings of the rotary cover align with the openings of the seat such that each supporting pipe is rotatable relative to the seat between an opening status and a folding status. When the rotary cover rotates to a second position, the openings of the rotary cover misalign with the openings of the seat such that each supporting pipe is retained in the opening status.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A toy supporting frame, comprising:

a seat having a plurality of pivoting openings;

a plurality of supporting pipes for hanging a toy, each supporting pipe having a first end placed in one of the pivoting openings and pivotally connecting to the seat so as to move between an opening status and a folding status; and a rotary cover mounted on the seat and having a plurality of third openings, the rotary cover being rotatable relative to the seat between a first position that the plurality of third openings align with the plurality of pivoting openings respectively for allowing the plurality of supporting pipes to rotate into the third openings to the folding status, and a second position that the plurality of third openings misalign with the plurality of pivoting openings for retaining the plurality of supporting pipes out of the third openings in the opening status.

2. The toy supporting frame of claim 1, wherein the seat comprises:

a first base having a plurality of first openings; and a second base mounted on the first base and having a plurality of second openings, each second opening corresponding to one of the first openings of the first base;

wherein the first opening and the corresponding second opening form the pivoting opening.

3. The toy supporting frame of claim 1, wherein the seat comprises a plurality of first stops and the rotary cover comprises a plurality of second stops on the surface facing the seat for engaging with the plurality of first stops to confine the rotary cover at the first position or the second position.

4. The toy supporting frame of claim 3, wherein the first stops and the second stops are protrusions and recesses fitting in to each other.

5. The toy supporting frame of claim 2, further comprising a plurality of pivots, the first base having an indentation on the wall near the first opening, the second base having an indentation on the wall near the second opening, and the pivot passing through the first end of the supporting pipe and placed at the two indentations for pivoting the supporting pipe to the seat.

6. The toy supporting frame of claim 1, further comprising a plurality of V-shape elastic pieces, each mounted inside the corresponding supporting pipe, the V-shape elastic piece having one protrusion at two arm ends respectively, the protrusions extending out of a hole of the supporting pipe, the seat having a hole on the wall near the pivoting opening for engaging with the protrusion so that the supporting pipe is pivotally connected to the seat.

7. The toy supporting frame of claim 1, wherein each of the plurality of supporting pipes further has a second end opposite to the first end for detachably connecting to a baby product.

8. The toy supporting frame of claim 1, wherein each of the supporting pipes further comprises a hanger for connecting to the toy, wherein the hanger can be a hook, a ring, or a connector that can be detached or fixed on the supporting pipe for connecting the toy.

9. The toy supporting frame of claim 1, wherein when the toy supporting frame is in the opening status, the plurality of supporting pipes expand radially, and when the toy supporting frame is in the folding status, the plurality of supporting pipes approach to one another.

10. A folding device for a toy supporting frame, comprising:

a seat comprising a plurality of pivoting openings and a plurality of first stops; and a rotary cover mounted on the seat and having a third opening, the rotary cover being rotatable relative to the seat between a first position that the third opening aligns with one of the plurality of pivoting openings, and second position that the third opening misaligns with any of the plurality of pivoting openings, the rotary cover comprising a plurality of second stops for engaging with corresponding plurality of first stops;

wherein the plurality of pivoting openings is pivotally connecting to an end of a supporting pipe for allowing the supporting pipe to move between an opening status and a folding status relative to the seat.

11. The folding device of claim 10, wherein the seat comprises:

a first base having a plurality of first openings; and a second base mounted on the first base and having a plurality of second openings, each second opening corresponding to one of the first openings;

wherein the first opening and the corresponding second opening form the pivoting opening.

12. The folding device of claim 11, wherein the plurality of first stops are on the second base and the plurality of second stops are on a surface of the rotary cover facing the second base for engaging with the corresponding plurality of first stops to confine the rotary cover at the first position or the second position.

13. The folding device of claim 12, wherein the first stops and the second stops are protrusions and recesses fitting in to each other.

14. The folding device of claim 11, wherein the second base is mounted on the first base via rivets.

15. The folding device of claim 11, further comprising a pivot, the first base having an indentation on the wall near the first opening, the second base having an indentation on the wall near the second opening, and the pivot passing through the end of the supporting pipe and placed at the two indentations for pivoting the supporting pipe to the seat.

* * * * *